US006924259B2

(12) United States Patent
Rodrigues et al.

(10) Patent No.: US 6,924,259 B2
(45) Date of Patent: Aug. 2, 2005

(54) AMINE COPOLYMERS FOR TEXTILE AND FABRIC PROTECTION

(75) Inventors: Klein A. Rodrigues, Signal Mountain, TN (US); Martin Crossman, Hixson, TN (US)

(73) Assignee: National Starch and Chemical Investment Holding Corporation, New Castle, DE (US)

( * ) Notice: Subject to any disclaimer, the term of this patent is extended or adjusted under 35 U.S.C. 154(b) by 223 days.

(21) Appl. No.: 10/124,358

(22) Filed: Apr. 17, 2002

(65) Prior Publication Data

US 2003/0199419 A1 Oct. 23, 2003

(51) Int. Cl.[7] ..... C11D 3/37; C11D 1/02; C11D 1/66

(52) U.S. Cl. ..... 510/476; 510/341; 510/350; 510/356; 510/433; 510/434; 510/477; 510/490; 510/499; 8/115.6; 8/181; 8/196

(58) Field of Search ..... 510/341, 350, 510/356, 433, 434, 476, 477, 490, 499; 8/115.6, 181, 196

(56) References Cited

U.S. PATENT DOCUMENTS

| | | | | | |
|---|---|---|---|---|---|
| 4,318,956 | A | * | 3/1982 | Stevens et al. | 442/93 |
| 5,308,532 | A | * | 5/1994 | Adler et al. | 510/223 |
| 6,140,292 | A | | 10/2000 | Randall et al. | 510/300 |
| 6,271,192 | B1 | * | 8/2001 | Verstrat et al. | 510/527 |
| 6,573,234 | B1 | | 6/2003 | Sivik et al. | 510/475 |
| 2001/0031714 | A1 | | 10/2001 | Gasenmeier et al. | 510/276 |
| 2003/0072950 | A1 | | 4/2003 | Rodrigues, et al. | |
| 2003/0199419 | A1 | * | 10/2003 | Rodrigues et al. | 510/475 |

FOREIGN PATENT DOCUMENTS

| | | | |
|---|---|---|---|
| DE | 43 23 638 A1 | 1/1995 | C11D/3/37 |
| WO | WO 99/14297 | 3/1999 | C11D/3/30 |
| WO | WO 00/22075 | 4/2000 | C11D/1/62 |
| WO | WO 00/49124 | 8/2000 | C11D/3/37 |
| WO | WO 00/56849 | 9/2000 | C11D/3/00 |
| WO | WO 03 011969 | 2/2003 | C08L/57/00 |

* cited by examiner

*Primary Examiner*—Brian P. Mruk
(74) *Attorney, Agent, or Firm*—David P. LeCroy

(57) ABSTRACT

The present invention relates to a detergent composition having from 3 to 75 percent by weight of at least one surfactant; and from 0.01 to 5 percent by weight percent of a copolymer composed of from 25 to 75 mole percent of at least one amine-functional monomer, and from 75 to 25 mole percent of at least one hydrophobic ethylenically unsaturated monomer, wherein said amine-functional monomer is not a quaternized amine, and wherein said copolymer has been at least partially neutralized. The detergent composition having the copolymers provides color protection and anti-pill properties in laundry applications.

18 Claims, No Drawings

AMINE COPOLYMERS FOR TEXTILE AND FABRIC PROTECTION

FIELD OF THE INVENTION

This invention relates to copolymers having amine functionality. The copolymers are at least partially neutralized to present an optimum balance between hydrophobicity and cationic character. The copolymers provide color protection and anti-pill properties in laundry applications.

BACKGROUND OF THE INVENTION

Fabrics and textiles become soiled over time and need to be cleaned. The cleaning operation removes dirt from the fibers, but in the process, fibers are dislodged from the woven and knit fabrics or textiles, resulting in lint, fuzz, or pills which remain on the surface of the material. In addition to the loss of fibers, the cleaning process can also remove some of the dyes, resulting in a fading of the fabric. Both mechanisms are detrimental to the fabric and result in an undesirable appearance.

Detergents are formulated with additives designed to associate with the fibers, and diminish the effect of wear, fiber loss, pilling and color-loss. An effective protective additive must a) have the ability to associate with the surface of the fibers, and not be easily removed, and b) must not adversely effect detergency or cleaning properties of the detergent, in other words must not attract dirt and other soils back onto the fibers.

One means of associating the protective additive to the fiber is to take advantage of the anionic nature of the fiber. Additives containing cationic moieties will be attracted to, and associate with, the anionic fibers, thus providing some protection to the fibers. Detergents containing linear polyamines are used in laundry detergent applications using this principal. The use of polyamines for this application is described in WO 99/14297, WO 00/49124, and U.S. Pat. No. 6,140,292.

WO 00/56849 discloses laundry detergent compositions having cationically charged polymers. The polymers are amine-containing homopolymers, copolymers, or the quaternized derivatives thereof. The objective of this application is to maximize the cationic component of the polymer, to increase the association between the polymer and the fibers. Anions are only disclosed in association with quaternized polymers.

Unfortunately, the cationic polymer additives also attract dirt; thus dirt which has been removed from the laundry is attracted back to the cationic polymer, and thus back to the clothes.

Another approach for associating a polymeric protective additive with fibers is to take advantage of the relative hydrophobic nature of the fibers compared to the aqueous environment of the wash liquor. A hydrophobic polymer will associate with fibers and will minimize exposure to the aqueous environment. On the other hand, a polymer having a high hydrophilic character, such as many of the polyamines and poly amino acids described in the art, will associate with the aqueous wash liquor, and will not deposit well onto the surface of the fibers. One way to overcome this disadvantage is to form a polymer having quaternized amines, as disclosed on WO 00/22075. Such a polymer has a high hydrophilic character, but is attracted to the fibers due to a strong cationic character. The negative side of the high cationic character is the attraction for dirt, and thus poor redeposition properties.

Polymers having a high degree of hydrophobicity are difficult to synthesize, since they tend to be water insoluble, and come out of solution when placed into an aqueous solution. The solubility of the polymer can be improved by reducing the level of hydrophobe, but this also reduces the positive fiber deposition properties associated with the hydrophobe.

Polymers having a high degree of hydrophobicity are described in U.S. patent application Ser. No. 09/920,498. The hydrophobically modified solution polymers may be used to provide color protection and anti-pilling properties to fabrics and textiles. The polymers contain at least 75 mole percent of the hydrophobic monomer, and the hydrophobic amine monomer was neutralized to improve solubility.

There is a need for a polymeric additive for protecting fibers during the cleaning process, having the proper balance between hydrophilic, hydrophobic, and cationic components to provide excellent protective properties to fibers while minimizing the negative effect on redeposition properties associated with cationic character. While not being bound to any theory, it is believed that the hydrophobe serves to minimize the interaction of the amine functionality with surfactants typically found in a detergent. The copolymer must balance the water solubility (amine groups) and the water insolubility (hydrophobic groups) on the polymer molecule, to optimize desired properties.

It has been found that an amine functional copolymer, that is at least partially neutralized, and that has greater than 20 mole percent of the amine moiety, which is balanced with a suitable level of nonionic and/or hydrophobic moieties, provides the advantage of color and wear protection to fibers, with a minimum of negative effects on redeposition properties.

SUMMARY OF THE INVENTION

The present invention is directed to a detergent composition comprising:

a) from 3 to 75 percent by weight of at least one surfactant; and b) from 0.01 to 5 percent by weight of a copolymer comprising:
   1) from 25 to 75 mole percent of at least one amine-functional monomer; and
   2) from 75 to 25 mole percent of at least one hydrophobic ethylenically unsaturated
   3) from 0 to 50 mole percent of an hydroxy functional ethylenically unsaturated monomer,
   4) from 0 to 10 mole percent of a diethylenically unsaturated monomer or polyfunctional wherein said amine-functional monomer is not a quaternized amine, and wherein said copolymer has been at least partially neutralized. The copolymer may be formed from additional monomers including 0 to 20 mole percent of an acid functional monomer, and 0 to 10 mole percent of a hydroxy, alkyl or aromatic capped poly(alkoxylated) monomer.

The invention is also directed to a woven or knit fibrous material that is coated on at least one side
with a copolymer comprising:

1) from 25 to 75 mole percent of at least one amine-functional monomer; and
2) from 75 to 25 mole percent of at least one hydrophobic ethylenically unsaturated
3) optionally from 0 to 50 mole percent of an hydroxy functional ethylenically unsaturated 4) optionally from 0 to 10 mole percent of a diethylenically unsaturated monomer or polyfunctional mercaptan, wherein said amine-functional monomer is not a quaternized amine. The copolymer may be formed from additional monomers including 0 to 20 mole percent of an acid functional monomer, and 0 to 10 mole percent of a hydroxy, alkyl or aromatic capped poly(alkoxylated) monomer.

DETAILED DESCRIPTION OF THE INVENTION

The present invention relates to a copolymer that is synthesized from at least one amine-functional monomer, and from at least one hydrophobic ethylenically unsaturated monomer.

Amine functional monomers useful in the invention include mono-, di-, tri-, and multi-amines. Examples of useful amine monomers include, but are not limited to N,N dialkylaminoalkyl(meth)acrylate, N,N dialkylaminoalkylacrylate, dialkylaminoalkyl(meth)acrylamide and N,N dialkylaminoalkylacrylamide, where the alkyl groups are independently $C_{1-18}$. Aromatic amine containing monomers such as vinyl pyridine may also be used. One skilled in the art will also be able to incorporate an amine functionality by reaction with a polymerizable anhydride (e.g. maleic anhydride), epoxide (e.g. glycidyl methacrylate), transesterification or condensation esterification or amidation. Furthermore, monomers such as vinyl formamide, vinyl acetamide, and the like which generate amine moieties on hydrolysis may also be used. Preferably the hydrophilic acid-neutralizable monomer is N,N-dimethylaminoethyl methacrylate, N,N-dimethylaminopropyl methacrylamide, or a mixture thereof. The amine does not include quaternary amines. It has been found that quaternary amines produce unsatisfactory redeposition properties. The copolymer contains from 25 to 75 mole percent of the amine-functional monomer, preferably from 25 to 70 mole percent, and most preferably from 25 to 60 mole percent, based on the total moles of monomer.

The hydrophobic monomer can be any ethylenically unsaturated monomer known in the art, or a mixture thereof. Examples of such monomers include, but are not limited to: (meth)acrylates, maleates, (meth)acrylamides, vinyl esters, itaconates, styrenics, unsaturated hydrocarbons and acrylonitrile, nitrogen functional monomers, vinyl esters, alcohol functional monomers, unsaturated hydrocarbons, and alkoxylated $C_8$–$C_{22}$ (meth)acrylates. Preferred hydrophobic monomers are vinyl monomers and acrylate monomers such as methyl methacrylate, ethyl acrylate, and butyl acrylate. The copolymer contains from 25 to 75 mole percent of the hydrophobic monomer, preferably 30 to 75 mole percent, and most preferably 40 to 75 mole percent.

In addition to the amine-functional monomer(s) and the hydrophobic monomer(s) the polymer of the invention may contain other monomeric units as known in the art, including, but not limited to, up to 50 mole percent and preferably from 5 to 25 mole percent of an hydroxy functional ethylenically unsaturated monomer, up to 10 mole percent of a diethylenically unsaturated monomer or a polyfunctional mercaptan, and/or up to 20 mole percent of a mono-or di-carboxylic acid monomer, up to 10 mole percent of an of a hydroxy, alkyl or aromatic capped poly(alkoxylated) monomer, or any combination thereof.

Small amounts of crosslinking monomer may be included in the polymer. If crosslinking monomers are used, preferably they form more flexible crosslinks, such as with polyethylene glycol decrylate.

The copolymer is synthesized by solution polymerization techniques, as described in U.S. patent application Ser. No. 09/690,387, incorporated herein by reference. The process involves polymerizing at least one amine-functional monomer and at least one hydrophobic ethylenically unsaturated monomer in a non-aqueous solvent, or non-aqueous/aqueous solvent mixture; forming an aqueous polymer dispersion; and adding an aqueous acid to at least partially neutralize the copolymer such that it becomes water soluble. The addition of the acid can occur either before, after, or during the formation of the aqueous polymer dispersion from the non-aqueous polymer solution.

The polymers formed from this type of process are generally random copolymers. However, other polymer architectures such as block, star etc may also be used. The special techniques used to synthesize these various types of polymer architecture are well known in the art.

The polymerization of the monomers in a non-aqueous solvent can be done by any means known in the art. The solvent should be miscible with water. Preferably the solvent is capable of forming an azeotrope with water. Examples of solvents useful in the present invention include, but are not limited to, alcohols such as methanol, ethanol, and isopropyl alcohol; glycol ethers; and acetone. If the solvent is a low boiling solvent, such as an alcohol or acetone, it may be stripped from the solution.

The final aqueous polymer composition is formed by the combination of the conversion of the polymer solution to an aqueous solution, and the addition of an acid. This results in a composition that may be either clear or hazy.

The copolymer is neutralized to achieve water solubility. For polymers having a large mole percent of hydrophobic monomer, near complete neutralization is required. For copolymers having less hydrophobic character, partial neutralization is sufficient to achieve solubility. In all cases, the copolymer is at least 30 percent neutralized, and preferably at least 50 mole percent neutralized.

The amine copolymer is combined with surfactants and other detergent components known in the art to form a detergent composition. The detergent composition is preferably a laundry composition in the form of granules, extrudates, flakes, tablets, liquids, gels, discrete doses or pastes.

The detergent composition, preferably comprises, by weight, 3 to 75 percent surfactant(s), 0 to 55 percent builder(s), and 15 to 95 percent of a combination of optional ingredients, such as buffers, enzymes, softeners, antistatic agents, fluorescers, dyes, perfumes, water and fillers. The amine copolymer is used at 0.01 to 5.0 percent, preferably 0.01 to 2.5 percent, more preferably from 0.1 to 2 percent, by weight, of the detergent formulation.

Optional components of the detergent formulations include, but are not limited to, ion exchangers, alkalis, anticorrosion materials, anti-redeposition materials, optical brighteners, fragrances, dyes, fillers, chelating agents, enzymes, fabric whiteners and brighteners, sudsing control agents, solvents, hydrotropes, bleaching agents, bleach precursors, buffering agents, soil removal agents, soil release agents, fabric softening agent and opacifiers.

In a laundering process, the detergent composition is applied to a fibrous material in an aqueous medium. The fibrous material may be a woven or knit fabric composed of natural fibers, synthetic fibers, or a mixture thereof.

In a textile finishing process, the amine copolymer contacts the textile by a padding or immersion process, an exhaustion process, or other processes known in art.

Carpet may be treated with the amine polymer, either as an initial or subsequent treatment.

The amine copolymer provides, anti-pilling, and color protection to the textile or fabric. The amine copolymer solubility can be pH triggered, from insoluble above about pH 9, to soluble below about pH 9. The trigger mechanism can be useful in controlled-release systems.

The hydrophobically modified amine copolymer is also useful as an additive to hard surface cleaners where they improve cleaning and extend the time interval between cleaning, in autodish applications to minimize filming or spotting on glassware. Additionally, the polymers have good film forming properties making them useful for coating or encapsulating an active ingredient that may be released by dissolution in water or triggered by a change in pH.

The following examples are presented to further illustrate and explain the present invention and should not be taken as limiting in any regard.

All percentages are based on mole and not weights.

EXAMPLE 1

DMAEMA/MMA 30/70

To a 2 liter glass vessel equipped with; reflux condenser, stirrer, means of temperature control, 400 g water and 300 g propan-2-ol were charged then heated to a gentle reflux. A monomer mixture of dimethylaminoethyl methacrylate (106.6 g) and methyl methacrylate (160 g) was fed into the reactor over an approximate timeframe of 3 hours. Sodium persulphate solution (8.7 g in 125 g of water) was fed concurrently with the monomer over a similar time period. When feeds were complete acetic acid solution (36.6 g in 150 g water) was fed into the reactor. A propan-2-ol azeotrope was then distilled from the reactor.

EXAMPLE 2

DMAEMA/EA 30/70

To a 2 liter glass vessel equipped with; reflux condenser, stirrer, means of temperature control, 300 g deionized water and 300 g propan-2-ol were charged then heated to a gentle reflux. A monomer mixture of dimethylaminoethyl methacrylate (134.6 g) and ethyl acrylate (200 g) was fed into the reactor over an approximate time frame of 3 hours. Sodium persulphate solution (3.4 g in 125 g of water) was fed concurrently with the monomer over a similar time period. When feeds were a propan-2-ol azeotrope was then distilled from the reactor, followed by neutralization with acetic acid (41.2 g).

EXAMPLE 3

DMAEMA/MMA 40/60

To a 2 liter glass vessel equipped with; reflux condenser, stirrer, means of temperature control, 400 g water and 300 g propan-2-ol were charged then heated to a gentle reflux. A monomer mixture of dimethylaminoethyl methacrylate (143.1 g) and methyl methacrylate (136.7 g) was fed into the reactor over an approximate timeframe of 3 hours. Sodium persulphate solution (8.7 g in 110 g of water) was fed concurrently with the monomer over a similar time period. When feeds were complete, hydrochloric acid solution (79.6 g of 37.6% active in 100 g water) was fed into the reactor. Residual monomers were scavenged over a 1 hour timeframe with sodium persulphate (1.5 g in 30 g of water). A propan-2-ol azeotrope was then distilled from the reactor with the aid of a defoaming agent, Foamblast 552 (0.16 g) available from Ross Chem. Inc. Distillate was replaced w/w with water during distillation.

EXAMPLE 4

DMAEMA/MMA 50/50

To a 2 liter glass vessel equipped with; reflux condenser, stirrer, means of temperature control, 400 g water and 300 g propan-2-ol were charged then heated to a gentle reflux. A monomer mixture of dimethylaminoethyl methacrylate (177.7 g) and methyl methacrylate (114.3 g) was fed into the reactor over an approximate timeframe of 3 hours. Sodium persulphate solution (8.7 g in 110 g of water) was fed concurrently with the monomer over a similar time period. When feeds were complete, hydrochloric acid solution (90 g of 32% active in 100 g water) was fed into the reactor. Residual monomers were scavenged over a 1 hour timeframe with sodium persulphate (1.5 g in 30 g of water). A propan-2-ol azeotrope was then distilled from the reactor with the aid of a defoaming agent, Foamblast 552 (0.16 g) available from Ross Chem. Inc. Distillate was replaced w/w with water during distillation.

EXAMPLE 5

DMAEMA/MMA/HPMA 30/50/20

To a 2 liter glass vessel equipped with; reflux condenser, stirrer, means of temperature control, 400 g water and 300 g propan-2-ol were charged then heated to a gentle reflux. A monomer mixture of dimethylaminoethyl methacrylate (106.6 g) and methyl methacrylate (113.9 g) and hydroxypropyl methacrylate (65.6 g) was fed into the reactor over an approximate timeframe of 3 hours. Sodium persulphate solution (8.7 g in 110 g of water) was fed concurrently with the monomer over a similar time period. When feeds were complete, hydrochloric acid solution (62.7 g of 37.6% active in 100 g water) was fed into the reactor. Residual monomers were scavenged over a 1 hour timeframe with sodium persulphate (1.5 g in 30 g of water). A propan-2-ol azeotrope was then distilled from the reactor with the aid of a defoaming agent, Foamblast 552 (0.16 g) available from Ross Chem. Inc. Distillate was replaced w/w with water during distillation.

EXAMPLE 6

DMAEMA/MMA/HBMA 30/50/20

To a 2 liter glass vessel equipped with; reflux condenser, stirrer, means of temperature control, 400 g water and 300 g propan-2-ol were charged then heated to a gentle reflux. A monomer mixture of dimethylaminoethyl methacrylate (106.6 g) and methyl methacrylate (113.9 g) and hydroxybutyl methacrylate (72.0 g) was fed into the reactor over an approximate timeframe of 3 hours. Sodium persulphate solution (8.7 g in 110 g of water) was fed concurrently with the monomer over a similar time period. When feeds were complete, hydrochloric acid solution (62.7 g of 37.6% active in 100 g water) was fed into the reactor. Residual monomers were scavenged over a 1 hour timeframe with sodium persulphate (1.5 g in 30 g of water). A propan-2-ol azeotrope was then distilled from the reactor with the aid of a defoaming agent, Foamblast 552 (0.16 g) available from Ross Chem. Inc. Distillate was replaced w/w with water during distillation.

EXAMPLE 7

Color Protection Properties of the Polymer of Example 4

A color protection evaluation was performed using lab-produced liquid built detergent. A base-line sample was run with the complete detergent and no polymer, then a control, which consisted of the complete detergent and the polymer of Example 4. The test was then designed to omit one component from the detergent for each of the runs, but included the same polymer in each. Swatches of seven different colors were washed in each of the detergent combinations, and the Delta E (difference in color after washing) was calculated after five complete wash/dry cycles.

| Liquid Built Detergent (LBD) formulation: | |
|---|---|
| Ingredient | % Wet |
| DI Water | 37.25 |
| Sodium Citrate | 9.0 |
| Propylene Glycol | 8.0 |
| Sodium Xylene Sulfonate | 18.75 |
| Biosoft D-40 | 20.0 |
| Neodol 25-9 | 7.0 |

TABLE 1

Test Conditions
Five cycles, including tumble dry after each
100 g/load liquid detergent
110° F., 10 minute wash/cold rinse
1% polymer in all cycles (except control)
10 ballast pillowcases

| Detergent | Delta E after 5 cycles | |
|---|---|---|
| Sample | Direct Blue 71 | Direct Black 22 |
| Control (no polymer) | 3.63 | 15.10 |
| Base LBD | 1.12 | 3.08 |
| w/o sodium citrate | 0.84 | 3.48 |
| w/o propylene glycol | 1.06 | 3.52 |
| w/o SXS | 1.00 | 4.57 |
| w/o Biosoft | 0.74 | 0.8 |
| w/o Neodol 25-9 | 0.97 | 3.42 |

EXAMPLE 8

Anti-pilling Testing

The anti-pilling tests were conducted as follows: The test was conducted over 5 or 10 full cycles using 118 g/load Xtra liquid detergent and 1% active polymer on detergent. The wash temperature was 93° F., with a 10-minute wash, and a cold rinse. The wash water was Chattanooga City water, which typically has a hardness of 70 ppm. 3 black knit swatches (Cotton Interlock knit TIC 460 from Textile innovators) and 3 white swatches (Bleached Cotton Interlock knit TIC 460 from Textile innovators) were attached to one pillowcase and 10 ballast pillowcases were used as ballast.

The white knit swatches were used to visually evaluate pilling, and the black knit swatches were used to evaluate color protection using a spectrophotometer.

TABLE 2

| | Pilling Resistance Evaluation | | Delta E |
|---|---|---|---|
| Sample | 5 cycles | 10 cycles | (Black Fabric) |
| Control | poor | poor | 18.33 |
| Polymer of Example 1 | very good | fair | 10.45 |
| Polymer of example 5 | Very good | Very good | 9.60 |
| Polymer of example 6 | good | good | 9.22 |

EXAMPLE 9

A copolymer of dimethyl aminoethyl methacrylate (DMAEMA)-co-methyl methacrylate (MMA, 70 mole %) was found to have excellent anti-pilling performance. Therefore, several evaluations were run on this polymer of Example 1, to determine if it would adversely affect laundry performance. Each evaluation is described below and followed by the results.

TABLE 3

Optical Brightener Deposition
1.6 g/L Arm & Hammer powder or liquid detergent
1% polymer, where indicated
110 ppm $H_2O$, 80 rpm, 93.4° F.
4 white cotton swatches

| | Whiteness Index | | | |
|---|---|---|---|---|
| | A&H Liquid detergent | | A&H Powder detergent | |
| Sample | Before wash | After wash | Before wash | After wash |
| Control | 80.20 | 109.12 | 80.50 | 110.02 |
| Example 1 | 79.61 | 108.87 | 80.76 | 108.39 |

The polymer did not significantly interfere with optical brightener deposition.

TABLE 4

Stain Removal
1.7 g/L Xtra detergent
1% polymer, where indicated
110 ppm $H_2O$, 80 rpm, 93.4° F.
3 white cotton swatches for test, one for ballast
3 pre-wash cycles, Ragu stain and overnight dry
Final wash includes polymer

| Sample | Average % Soil Release |
|---|---|
| Control | 68.64 |
| Example 1 | 70.28 |

Some small improvement in stain release was realized with the addition of the polymer.

TABLE 5

Color Protection
118 g/Load (full scale) Xtra liquid detergent
1% polymer, where specified
City $H_2O$, 10 minute wash, 93° F.
One direct dyed swatch of each color attached to ballast fabric

| | Delta E after washing | |
|---|---|---|
| Fabric Swatch | Control | Example 1 |
| Direct Black | 1.95 | 1.04 |
| Direct Blue 80 | 2.28 | 1.40 |
| Direct Orange 39 | 1.91 | 1.55 |
| Direct Blue 86 | 1.06 | 0.34 |
| Direct Red 243 | 0.71 | 0.82 |

The data in the Table indicate that the DMAEMA-MMA copolymer has color protection properties in addition to anti-pilling properties.

In addition, it may be used as a control release agent that is insoluble in the wash cycle but soluble in the rinse, thus delivering actives in the rinse.

EXAMPLE 10

Comparative

The polymers tested are listed in the Table below.

TABLE 6

Soil Anti-Redeposition Test Conditions
2 wash/dry cycles
1.7 g/L Xtra liquid detergent
1% polymer
0.9 grams bandy black,
150 ppm $H_2O$, 80 rpm, 93.4° F.
10 minute wash, 3 minute rinse
3 EMPA 213, 3 419W cotton, 3 #400 cotton (as ballast)

| | | Delta Whiteness Index | |
|---|---|---|---|
| Sample | Polymer description | Cotton | Poly/Cotton |
| Control | | 20.33 | 7.32 |
| Comparative | Homopolymer of DMDAAC | 28.03 | 31.47 |
| Comparative | Homopolymer of DMAEMA | 30.62 | 21.88 |
| Example 1 | DMAEMA-MMA (70 mole %) | 21.61 | 9.93 |

The data in the Tables indicate that the homopolymer of DMDAAC and DMAEMA have very poor anti-redep performance. However, a hydrophobically modified amine polymer does not adversely affect anti-redep performance.

EXAMPLE 11

Typical Hard Surface Cleaning Formulations

| Ingredient | wt % |
|---|---|
| Acid Cleaner | |
| Citric acid (50% solution) | 12.0 |
| C12–15 linear alcohol ethoxylate with 3 moles of EO | 5.0 |
| Alkylbenzene sulfonic acid | 3.0 |
| Polymer of Example 3 | 1.0 |
| Water | 79.0 |

-continued

| Ingredient | wt % |
|---|---|
| Alkaline Cleaner | |
| Water | 89.0 |
| Sodium tripolyphosphate | 2.0 |
| Sodium silicate | 1.9 |
| NaOH (50%) | 0.1 |
| Dipropylene glycol monomethyl ether | 5.0 |
| Octyl polyethoxyethanol, 12–13 moles EO | 1.0 |
| Polymer of example 4 | 1.0 |

EXAMPLE 12

Typical Automatic Dishwash Formulation

| Ingredients | wt % |
|---|---|
| Sodium tripolyphosphate | 25.0 |
| Sodium carbonate | 25.0 |
| C12–15 linear alcohol ethoxylate with 7 moles of EO | 3.0 |
| Polymer of Example 4 | 4.0 |
| Sodium sulfate | rest |

EXAMPLE 13

Car Wash Rinse Off Aid Formulation

| Ingredients | wt % |
|---|---|
| Water | 80 |
| Butyldiglycol | 10 |
| Polymer of Example 4 | 10 |

EXAMPLE 14

Film Forming

Polymers from examples 2,3 & 6 were cast onto a polyethylene surface and left to dry at room temperature.

TABLE 7

| Polymer | Film |
|---|---|
| Example 2 | Good, tacky, elastic |
| Example 3 | Good, flexible slightly brittle |
| Example 6 | Poor, brittle |

Films are soluble in water.

EXAMPLE 15 pH Solubility of Example 1

The polymer of example 1 was diluted to a 1% solution. The pH was adjusted with 2% NaOH solution.

TABLE 8

| pH of solution | Appearance |
|---|---|
| 2.5 | Clear |
| 6.0 | Clear |
| 7.8 | cloudy |

EXAMPLE 16 pH Solubility of Example 3

The polymer of example 3 was diluted to a 1% solution. The pH was adjusted with 2% NaOH solution.

TABLE 9

| pH of solution | Appearance |
|---|---|
| 3.0 | Clear |
| 7.9 | Clear |
| 8.4 | cloudy |

EXAMPLE 17 pH Solubility of Example 6

The polymer of example 6 was diluted to a 1% solution. The pH was adjusted with 2% NaOH solution.

TABLE 10

| pH of solution | Appearance |
|---|---|
| 2.9 | Clear |
| 6.4 | Clear |
| 7.0 | Slight precipitate |
| 7.5 | Cloudy |

What is claimed is:

1. A detergent composition comprising:

from 3 to 75 percent by weight of at least one anionic or nonionic surfactant; and from 0.01 to 5 percent by weight percent of a copolymer having from 25 to 70 mole percent of at least one amine-functional monomer;

from 30 to 75 mole percent of at least one non-associative hydrophobic ethylenically unsaturated monomer;

from 0 to 50 mole percent of all hydroxy functional ethylenically unsaturated monomer; and from 0 to 10 mole percent of a diethyknically unsaturated monomer or polyfunctional mercaptan;

wherein said amine-functional monomer is not a quaternized amine, and wherein said copolymer has been at least partially neutralized.

2. The copolymer of claim 1 wherein said amine functional monomer is selected from the group consisting of N,N dialkylaminoalkyl methacrylate, N,N dialkyfaminoalkyl acrylate, dialkylaminoalkyl methacrylamide, and N,N dialkylaminoalkyl acrylamide, where the alkyl groups are independently $C_{1-18}$ and mixtures thereof.

3. The copolymer of claim 1 wherein said amine functional monomer is selected from the group consisting of N,N-dimethylaminoethyl methacrylate, and N,N-dimethylaminopropyl acrylamide.

4. The copolymer of claim 1 wherein said hydrophobic ethylenically unsaturated monomer is selected from the group consisting of (meth)acrylates, maleates, (meth) acrylamides, vinyl esters, itaconates, styrenics, unsaturated hydrocarbons and acrylonitrile, nitrogen functional monomers, vinyl esters, alcohol functional monomers, unsaturated hydrocarbons, and $C_8$–$C_{22}$ alkoxylated (meth) acrylates and mixtures thereof.

5. The detergent composition of claim 1 comprising from 0.01 to 2.5 weight percent of said copolymer.

6. The detergent composition of claim 5 comprising from 0.1 to 2.0 weight percent of said copolymer.

7. The copolymer of claim 1 compolymer from 25 to 70 mole percent of at least one amine, from 30 to 75 mole percent of at least one hydrophobic ethylenically unsaturated monomer, and from 5 to 25 mole percent of at least one hydroxy functional ethylenically unsaturated monomer.

8. The copolymer of claim 1 wherein said copolymer is at least 30 percent neutralized.

9. The copolymer of claim 1 further comprising from 0 to 20 mole percent of an acid functional monomer.

10. The copolymer of claim 1 further comprising from 0 to 10 mole percent of a hydroxy, alkyl or aromatic capped poly(alkoxylated) monomer.

11. A fibrous material comprising:

a woven or knit natural fibrous substrate; and a protective coating having a copolymer having from 25 to 75 mole percent of at least one amine-functional monomer;

from 25 to 75 mole percent of at least one non-associative hydrophobic ethylenically unsaturated monomer;

from 0 to 50 mole percent of an hydroxy functional ethylenically unsaturated monomer; and from 0 to 10 mole percent of a diethylenically unsaturated monomer or polyfunctional mercaptan;

wherein said amine functional monomer is not a quaternized amine, wherein said copolymer has been at least 30 percent neutralized, and wherein said protective coating reduces pilling on fibrous material when compared to fibrous material without the protective coating.

12. The fibrous material of claim 11 wherein said fibrous substrate is selected from the group consisting of textiles, woven fabrics, knit fabrics, and carpet.

13. The fibrous material of claim 11 wherein said copolymer further comprises from 0 to 20 mole percent of an acid functional monomer.

14. The fibrous material of claim 11 wherein said copolymer further comprises from 0 to 10 mole percent of a hydroxy, alkyl or aromatic capped poly(alkoxylated) monomer.

15. The detergent composition of claim 1 comprising a tablet or sachet and a film formed from the copolymer, wherein the film at least partially covers the external surface of said tablet or sachet.

16. A method for the delivery of an active ingredient comprising:

associating, coating or encapsulating an active ingredient with an at least partially neutralized copolymer having from 25 to 70 mole percent of at least one amine-functional monomer;

from 30 to 75 mole percent of at least one non-associative hydrophobic ethylenically unsaturated monomer;

from 0 to 50 mole percent of an hydroxy functional ethylenically unsaturated monomer, and from 0 to 10 mole percent of a diethylenically unsaturated monomer or polyfunctional mercaptan;

wherein said amine-functional monomer is not a quaternized amine, and introducing said coated or encapsulated active ingredient into an aqueous environment, resulting in the release of the active ingredient.

17. The method of claim 16 further comprising decreasing the pH of the aqueous environment to solubilize the copolymer, wherein said active ingredient is not released into the aqueous environment until after the pH decrease occurs.

18. The fibrous material of claim 11 wherein said protective coating improves color protection of fibrous material when compared to fibrous material without the protective coating.

* * * * *